United States Patent [19]

Angelastro

[11] 4,170,333

[45] Oct. 9, 1979

[54] HANGER DEVICE AND METHOD FOR SUSPENDING AN IMPLEMENT

[75] Inventor: Leonard W. Angelastro, South Windham, Conn.

[73] Assignee: John W. Stevens, Columbia, Conn.

[21] Appl. No.: 844,536

[22] Filed: Oct. 25, 1977

Related U.S. Application Data

[63] Continuation-in-part of Ser. No. 736,129, Oct. 27, 1976, abandoned.

[51] Int. Cl.[2] ..... A46B 17/02

[52] U.S. Cl. ..... 248/110

[58] Field of Search ..... 24/249 R, 257 R, 259, 24/248 C, 248 CR, 248 L, 115 A, 115 H, 115 K, 129 R, 129 B, 129 A, 132 R, 132 AS; 248/534–541, 511, 512, 54, 110–113, 315, 316 R, 60, 302, 251, 274, 309 R, 218.4, 219.1, 58, 74 R, 62–64; 211/60, 65, 66, 89, 68, 120

[56] References Cited

U.S. PATENT DOCUMENTS

| | | | |
|---|---|---|---|
| 513,202 | 1/1894 | Sasse | 211/60 T |
| 1,447,579 | 3/1923 | Thomas | 211/60 R |
| 1,598,403 | 8/1926 | Stockard | 24/249 R |
| 1,803,569 | 5/1931 | Taylor | 24/249 R |
| 2,131,956 | 10/1938 | Jones | 24/257 R |
| 2,221,801 | 11/1940 | Keppinger | 24/257 R |
| 2,618,419 | 11/1952 | Vanish | 211/60 T X |
| 2,911,172 | 11/1959 | Clayton et al. | 248/113 |
| 2,987,285 | 6/1961 | Andrews | 248/113 |

FOREIGN PATENT DOCUMENTS

| | | | |
|---|---|---|---|
| 1383396 | 11/1964 | France | 248/315 |

*Primary Examiner*—William H. Schultz

*Attorney, Agent, or Firm*—Prutzman, Kalb, Chilton & Alix

[57] ABSTRACT

A method is disclosed for suspending an implement such as a tool having an elongated handle or the like on a wall or similar supporting structure. A hanger is provided which comprises a loop of flexible but relatively nonstretchable material secured to the supporting structure or to a bracket or base mounted on the supporting structure with the bight of the loop inclined at an angle of at least 30° to the horizontal. The loop is dimensioned relative to the size of the handle so that the handle when inclined in the opposite direction may be readily inserted through the loop and when returned to vertical position will twist the loop and be securely gripped thereby.

5 Claims, 11 Drawing Figures

HANGER DEVICE AND METHOD FOR SUSPENDING AN IMPLEMENT

RELATED APPLICATION

This application is a continuation-in-part of my copending application Ser. No. 736,129, filed Oct. 27, 1976 and entitled "Implement Hanger," which application is now abandoned.

The present invention relates to a method of hanging implements on a wall or similar supporting structure, the implements being of the type which have elongated end portions or handles by means of which they may be suspended. The invention further relates to a novel hanging device adapted to be mounted on a wall or other supporting structure for use in practicing the method for holding in suspension tools, utensils, parts and the like, herein referred to collectively as implements.

It is a common practice to dispose or store implements when not in use by hanging them on a wall or similar convenient vertical supporting structure. Various forms of clamps and spring devices, usually formed of metal, are available for this purpose, but in general, they are difficult to use, do not function or wear well, and frequently damage the handle of the implement. In order to overcome these difficulties it has been proposed heretofore to use various elastic devices for clasping the implement handle as, for example, in accordance with the disclosure in French Pat. No. 1,383,396, to engage the handle of the implement in a stretched loop of elastic, but such fasteners are insecure particularly if the handle does not have an enlarged end, variations in the weight of the implement being suspended can be detrimentaly critical, and the user must learn the technique for manipulating the handle and hanger in order to use it effectively.

Accordingly, it is an object of the invention to provide an improved hanger and method of using it which overcomes the disadvantages of the prior art particularly with respect to simplicity and ease of operation and with respect to security and reliability of the holding action.

Another object is to provide such a hanger for use in the method of my invention which is simple and economical to fabricate and install, which can accommodate handles of various sizes, and which will have a long service life without evidencing undue wear or deterioration of effectiveness or requiring replacement.

Other objects will be in part obvious and in part pointed out in more detail hereinafter.

A better understanding of the invention will be obtained from the following description and the accompanying drawings of illustrative applications of the invention.

DESCRIPTION OF THE PREFERRED EMBODIMENTS

Figure 1:
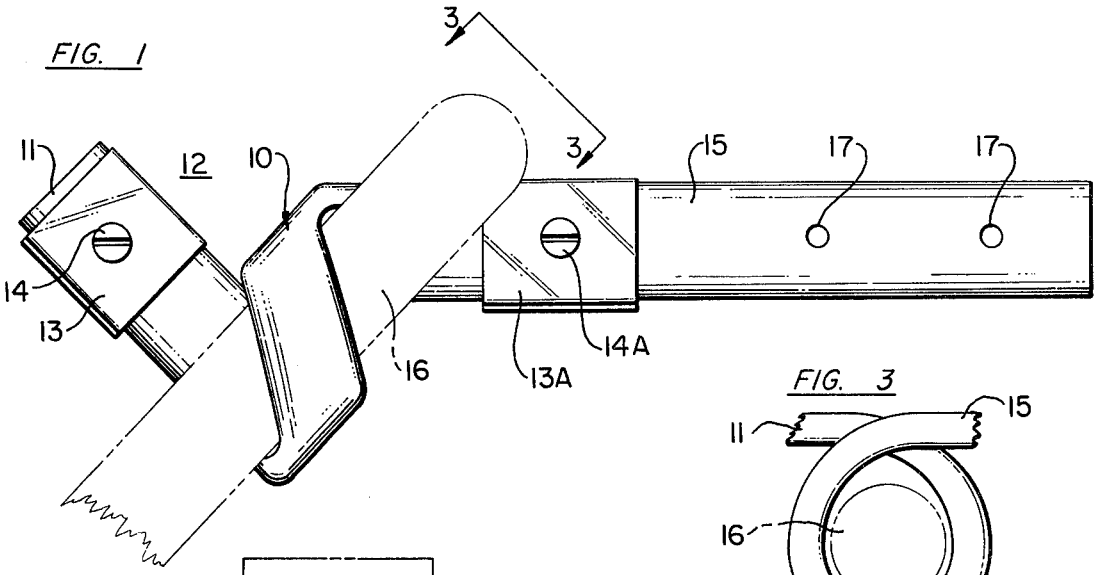
FIG. 1 is a front elevational view of a hanger embodying the invention with a fragmentary portion of an implement handle being inserted therein preliminary to suspending the implement.

Referring to the drawings in detail, and particularly to FIGS. 1–5 showing a preferred embodiment of the hanger of my invention, the principal element of the hanger is a strap 10 of flexible, stretch-resistant material. One end 11 of the strap 10 is secured to a supporting surface such as the wall 12 by a suitable fastener such as the clip 13 and screw 14. Strap end 11 is secured to the wall 12 so that as viewed in FIGS. 1 and 2, it extends to the right and downwardly at an acute angle to the vertical of about 30 to 60 degrees and preferably at an angle of about 45 degrees. After end 11 is secured as described, the strap is then formed into a helix or spiral by twisting it axially in a clockwise direction to the extent of a half turn (180 degrees) and the other end portion 15 is then secured to the supporting surface by a second clip 13A and screw 14A, the screws 14 and 14A preferably being in approximate horizontal alignment.

Figure 3:
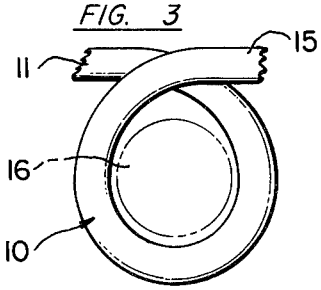
FIG. 3 is a partial end view of the parts shown in FIG. 1 looking along the axis of the handle as indicated by direction line 3—3 of FIG. 1.
Figure 2:
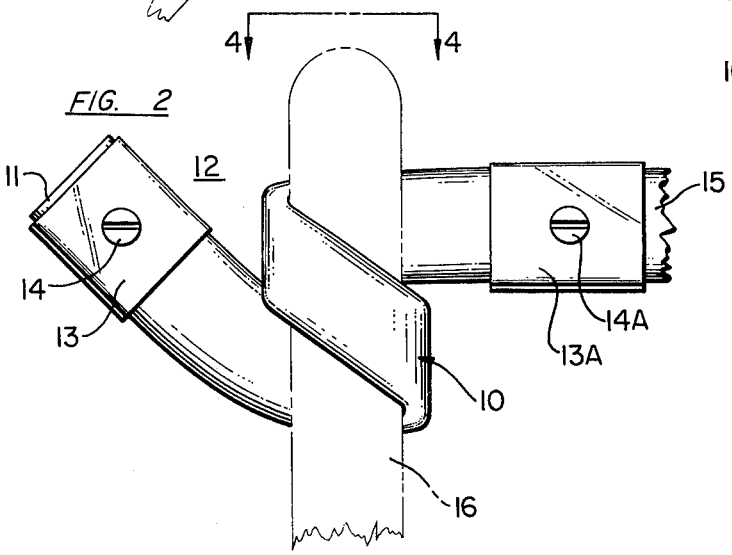
FIG. 2 is a fragmentary view similar to FIG. 1 but with the handle turned to vertical suspended position.
Figure 4:
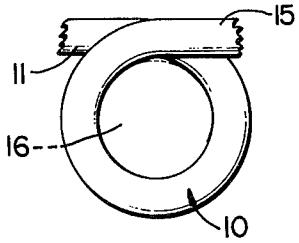
FIG. 4 is a view similar to the view of FIG. 3 of the parts shown in FIG. 2 as indicated by direction line 4—4 of FIG. 2.

The effective length of the strap 10 and the spacing or distance separating the clips 13 and 13A is preselected in accordance with the size of the handle that is to be suspended. The object is to form a loop of sufficient size so that when a handle such as the exemplary handle 16 is inclined at an angle normal to the strap end 11 and inserted into the loop as shown in FIG. 1 there will be sufficient clearance as shown in FIG. 3 so that the handle can be easily inserted without obstruction. At the same time the loop has to be small enough so that when the handle 16 is permitted to swing to the vertical under the weight of the implement causing twisting of the loop as illustrated in FIG. 2, the loop will become tightly engaged with the handle as illustrated in FIG. 4 preventing it from slipping and becoming dislodged. By way of example, a strap having an effective length of about 7 inches and secured with the screws 14, 14A spaced apart about 3 inches is very effective with implement handles having a diameter in the range of $\frac{3}{4}$ to 1 inch. Similarly, if the distance between the screws is increased to about 4 inches, a strap having an effective length of about $8\frac{1}{2}$ inches is suitable for handles having a diameter in the range of 1 to $1\frac{1}{2}$ inches and a strap having an effective length of about 10 inches is suitable for handles having a diameter in the range of $1\frac{1}{2}$ to $2\frac{1}{4}$ inches. In order to make it convenient to preselect the effective length of the strap, the strap preferable is made longitudinally adjustable with respect to the clip 13A. In the specific embodiment this is accomplished by forming a plurality of holes 17 for receiving the screw 14A at varying distances along the strap end 15.

In the specific embodiment shown in FIGS. 1–5 of the drawing, the strap 10 is shown as a solid piece of rubber or rubber-like material having a generally rectangular cross-section of the order of ¼ inch in thickness and about ¾ inch wide. A strap of these dimensions will exhibit a sufficient resistance to elongation or stretching to cause a strong clamping action on the handle being suspended. Straps of other cross-sectional shapes and other stretch-resistant materials such as fiber reinforced tubing or even metal strapping may be substituted if desired.

As described above, the method of suspending an implement handle requires the steps of inclining or tilting the handle so that it is approximately normal to the strap end 11 and then inserting it through the loop as illustrated in FIG. 1 following which the handle is turned or permitted to turn to the vertical as shown in FIG. 2, the position to which the implement handle is biased by the implement's own weight. This results in a twisting of the loop in a counter-clockwise direction as viewed in FIGS. 1 and 2 which reduces the inside diameter of the loop as shown by the comparison of FIG. 4 with FIG. 3, thereby creating a powerful clamping action on the handle. In general, the heavier the implement, the stronger the clamping action produced. To release the implement, the procedure is simply reversed, i.e. the handle is returned to the original inclined position and withdrawn.

Figure 5:
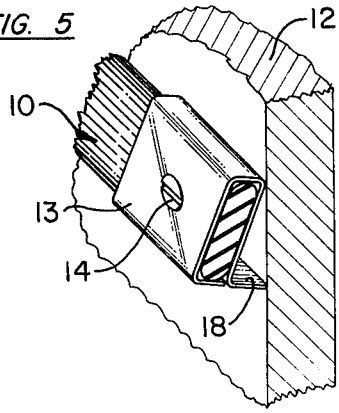
FIG. 5 is a fragmentary perspective view showing the clip element of FIGS. 1 and 2.
Figure 6:
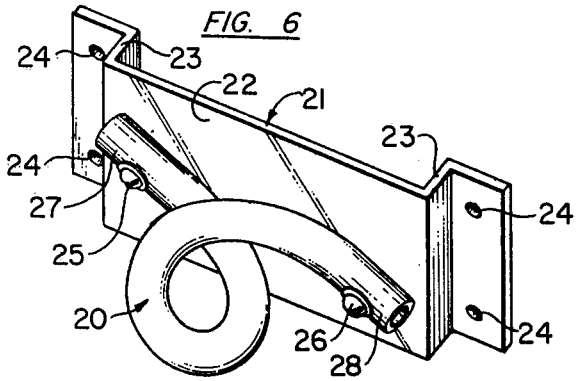
FIG. 6 is a perspective view of a modified hanger embodying the present invention.

When the strap 10 is fastened to a supporting structure such as a wall, the end portions 11, 15 may be placed flat against the wall. However, to facilitate insertion and release of a handle, particularly when two or more hangers are used in a row, it is preferred to tilt or cant the loop of the hanger so that the bottom end of the implement will extend away from the base of the wall a slight amount to provide clearance when its handle is aligned with the axis of the loop for insertion. A convenient way to accomplish this is by the design of the clips 13, 13A as best shown in FIG. 5. Referring to FIG. 5 it will be noted that the clip is merely a sheet of metal bent into rectangular shape to extend around the strap end and having a flange 18 along one edge which engages against the wall 12 to space the edge away from the wall and give the clip and hence the strap the desired tilt.

The hanger as described may be regarded as a "left-hand" hanger in that the left hand end 11 of the strap 10 is fastened to the wall 12 at an inclined angle and the strap 10 is formed into a loop with a clockwise twist so as to permit the handle 16 of the implement to be inserted from the left side as illustrated in FIG. 1. As will be apparent, the parts may be reversed if desired so that the right hand end 15 of the strap is attached to the wall 12 at an angle and the strap 10 is formed into a loop with a counterclockwise twist to permit the handle 16 to be inserted from the right side. In any case, it is the strap end which extends from and forms the bottom of the loop that is attached to the supporting surface at the prescribed angle.

Turning now to the hanger embodying the invention as shown in FIGS. 6–11 of the drawings, this hanger comprises a loop 20 of rubber or rubber-like material secured to a mounting bracket 21 which in turn is adapted to be mounted on a supporting wall or other structure. For illustrative purposes, the loop in this embodiment is formed of a loop of rubber tubing.

The bracket or base 21 may be made of any suitable material such as sheet metal or plastic. While the bracket 21 can have a variety of shapes or even be a flat plate the preferred example shown in the drawing has been selected because the loop mounting surface 22 is offset from a supporting wall structure (not shown) by the legs 23 which are provided with screw holes 24 for mounting purposes. This offset relationship of the surface 22 is advantageous because when an implement is suspended from the loop 20, it will hang free of the supporting wall structure. If desired, the bracket 21 can be mounted at one end only and formed so that it extends outwardly at right angles to the supporting wall structure. This may be advantageous in some installations to facilitate the insertion and removal of the implement into and from the loop 20 as explained more fully hereinafter.

Figure 7:
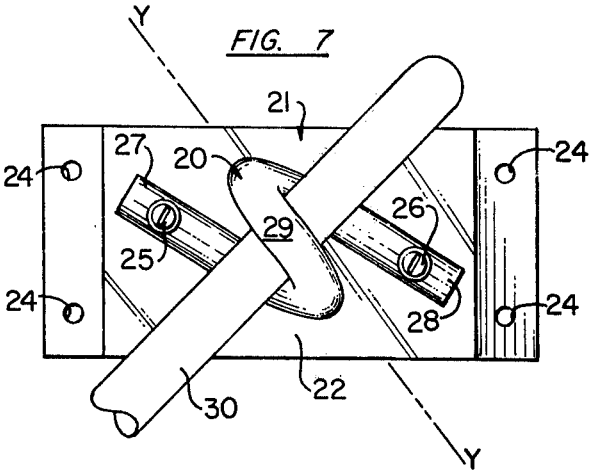
FIG. 7 is a front elevational view of the hanger of FIG. 6 showing a fragmentary portion of an implement handle being inserted therein.
Figure 8:
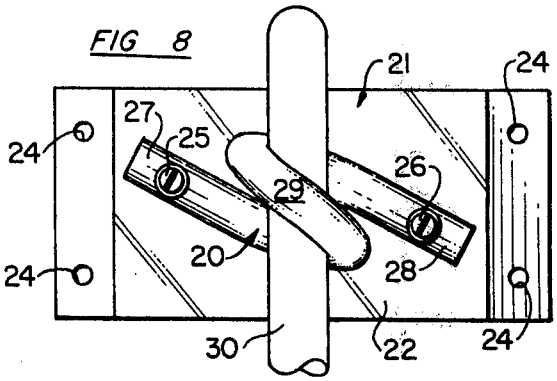
FIG. 8 is a view similar to FIG. 7 but with the handle in suspended position.
Figure 9:
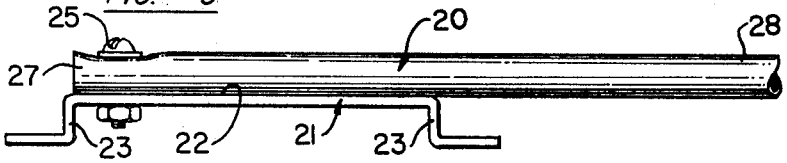
FIGS. 9, 10, and 11 are bottom views showing three stages of a method of fabricating the hanger shown in FIGS. 6–8.
Figure 10:
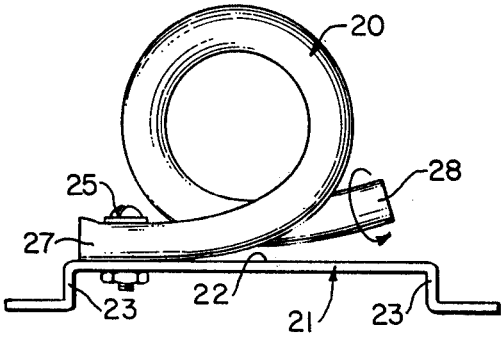
Figure 11:
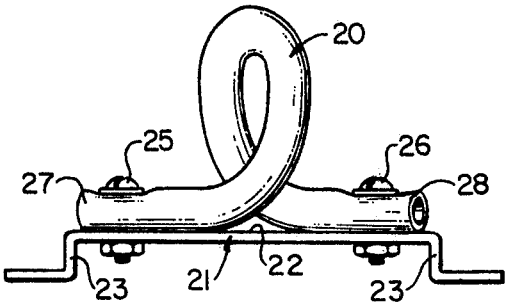

In the specific embodiment shown in the drawing, the loop 20 is secured to the base 21 by screw fasteners 25, 26 passing through the respective ends 27, 28 of the loop although if desired, other forms of fasteners may be substituted. A preferred manner of forming the loop 20 to obtain the desired configuration referred to is illustrated in FIGS. 9–11 of the drawing. As shown in FIG. 9, the end 27 of the length of tubing or similarly dimensioned rubber or rubberlike member is first secured adjacent one edge of the mounting bracket 21 by the fastener 25. In the next step, as shown in FIG. 10, a conventional loop is formed and then the tube or piece is given a reverse axial twist in the direction of the arrow shown in FIG. 10. Only a slight reverse axial twist is required, preferably only about a three-quarter turn. In the final step, as shown in FIG. 11, the end 28 is stretched slightly outwardly while maintaining the twist and is secured to the bracket 21 by the fastener 26. As best shown in FIGS. 7 and 8, the proper orientation of the bight 29 in about a 45° angle plane requires that the fasteners be placed in approximate horizontal alignment but with the right hand fastener 26 slightly lower than the fastener 25.

As in the case of the embodiment shown in FIGS. 1–5, the loop 20 has to be made of a flexible but relatively stiff and stretch-resistant material and has to be dimensioned in relationship to the size of the handle which is to be suspended. By way of specific example, for hanging brooms or garden utensils such as rakes or shovels, a loop made of nylon reinforced ½ inch diameter hose has been found to give good results. For smaller implements such as hand tools, loops made of smaller diameter tubing may be used. This size of the loop, by which is meant the diameter of the opening formed by the bight 29 as measured in the y—y plane, has to be at least as large and preferably slightly larger than the handle or other elongated portion of the implement to be inserted. For most brooms and garden utensils a diameter of about 1¼ inches is generally effective and in the case of ½ inch diameter hose, this requires a length of about 10 inches.

As shown in FIGS. 7 and 8, the handle 30 of an exemplary implement to be inserted into the loop 20 is first inclined or tilted so that it is at approximate right angles to the bight 29, i.e., in alignment with the axis of the opening provided by the loop 20 in its normal or at rest position as shown in FIG. 7 in which position the loop will fit loosely around the handle. Subsequently, when the handle 30 is let go to move by gravity or is otherwise moved to the vertical as shown in FIG. 8, accompanied by a corresponding twisting of the loop 20, the handle will be securely gripped by the sides of the loop 20 and prevented from slipping downwardly. To release and withdraw the implement from the hanger, the reverse operation is performed, i.e., the handle is returned to the inclined or tilted position to release the grip of the loop 20 and permit the handle to be withdrawn. The inherent stiffness of the loop 20 helps to restore it to original position for a good release. As will be appreciated, if the bracket 21 is mounted at both ends on and parallel to a supporting surface, the tilting movement of the handle 30 required for the insertion into and withdrawal from the loop 20 will be in a plane parallel to the supporting surface. However, if the bracket 21 is mounted at the right hand end only and extends at right angles to the supporting surface, then the insertion and releasing movement of the handle will also be in a plane at right angles to the supporting surface. This latter type of installation is particularly advantageous where there are space limitations that would prevent adequate tilting of the implement parallel to the supporting surface.

For simplicity, the invention has been shown embodied in a hanger consisting of a single loop 20 mounted on a bracket 21 of commensurate size. As will be apparent, the size of the bracket 21 can be readily increased and two or more loops 20 in horizontal alignment or in staggered relationship may be provided on a single bracket.

As will be apparent to persons skilled in the art, various modifications, adaptations and variations of the foregoing specific disclosure can be made without departing from the teachings of the present invention.

I claim:

1. A method of suspending an implement of the type having an elongated handle or end portion comprising forming an elongated flexible member of stretch-resistant material into a spiral loop, securing the loop to an upright supporting surface with the loop disposed in a plane substantially at right angles to the supporting surface but with the bight of the loop at an acute angle to the vertical, tilting the implement so that the elongated handle or end portion is in alignment with the axis of the loop and inserting it endwise through the loop, and thereafter turning the implement to vertical position to twist the loop and cause it to tighten around the handle or end portion.

2. A method as defined in claim 1 wherein the steps of forming and securing a spiral loop to a supporting surface comprises securing one end of a flexible strap of stretch-resistant material to the supporting surface at an angle of approximately 45 degrees to the vertical, twisting the strap axially to form a spiral loop, and securing the other end of the strap to the supporting surface to dispose the bight of the loop at an angle in the range of about 30 to 60 degrees to the vertical.

3. A hanger for suspending an implement of the type having an elongated handle or end portion, said hanger comprising an elongated strap of flexible stretch-resistant material twisted axially to form a spiral loop, and fastening means attaching the ends of the loop to an upright supporting surface and positioning the loop in a plane substantially at right angles to the supporting surface but with the bight of the loop tilted at an acute angle to the vertical, whereby the elongated portion of an implement when tilted at an opposite angle to the vertical may be inserted into the loop, said loop being sufficiently flexible to permit the implement to be returned to vertical position while the elongated portion of the implement is inserted in the loop and being sufficiently stretch-resistant so that the elongated portion will be retained by tightening of the loop about the elongated portion of the implement when the loop is twisted by return of the implement to a vertical position, said fastening means comprising clamps, at least one of which is adjustable longitudinally of the strap to vary the size of the loop.

4. A hanger for suspending an implement of the type having an elongated handle or end portion, said hanger comprising an elongated strap of flexible stretch-resistant material twisted axially to form a spiral loop, and fastening means attaching the ends of the loop to an upright supporting surface with the lower edge of the strap spaced outwardly of the surface and positioning the loop in a plane substantially at right angles to the supporting surface but with the bight of the loop tilted at an acute angle to the vertical, whereby the elongated portion of an implement when tilted at an opposite angle to the vertical may be inserted into the loop, said loop being sufficiently flexible to permit the implement to be returned to vertical position while the elongated portion of the implement is inserted in the loop and being sufficiently stretch-resistant so that the elongated portion will be retained by tightening of the loop about the elongated portion of the implement when the loop is twisted by return of the implement to a vertical position.

5. A hanger as defined in claim 4 wherein the fastening means comprises a clamp encircling the strap and having a longitudinal flange tilting the clamp and strap relative to the supporting surface.

* * * * *